US007900320B2

(12) United States Patent
Katsumata et al.

(10) Patent No.: US 7,900,320 B2
(45) Date of Patent: Mar. 8, 2011

(54) OPENING/CLOSING DEVICE FOR DOCUMENT PRESSING DEVICE

(76) Inventors: Tsutomu Katsumata, Osaka-hu (JP); Hirofumi Kohda, Osaka-hu (JP)

( * ) Notice: Subject to any disclaimer, the term of this patent is extended or adjusted under 35 U.S.C. 154(b) by 777 days.

(21) Appl. No.: 11/703,825

(22) Filed: Feb. 8, 2007

(65) Prior Publication Data

US 2008/0040979 A1 Feb. 21, 2008

(51) Int. Cl.
*E05F 1/08* (2006.01)

(52) U.S. Cl. ..... 16/286; 16/298; 355/75; 399/380

(58) Field of Classification Search ..... 16/286, 16/250, 298, 299, 327, 281, 284, 322, 306; 49/405; 355/75; 248/284.1, 276.1, 286.1, 248/287.1; 399/380
See application file for complete search history.

(56) References Cited

U.S. PATENT DOCUMENTS 6,415,477 B1 * 7/2002 Hosaka et al. ..... 16/327
6,456,365 B1 * 9/2002 Hosaka et al. ..... 355/75
6,886,220 B2 * 5/2005 Kuramochi ..... 16/286
7,012,675 B1 * 3/2006 Zhang et al. ..... 355/75
7,337,499 B2 * 3/2008 Zhang et al. ..... 16/357
7,512,376 B2 * 3/2009 Suzuki ..... 399/380
2007/0067955 A1 * 3/2007 Jing ..... 16/286

FOREIGN PATENT DOCUMENTS

JP 2006010979 A * 1/2006

* cited by examiner

*Primary Examiner* — William L. Miller
(74) *Attorney, Agent, or Firm* — Abraham Hershkovitz; Harold L. Novick; Hershkovitz & Associates, LLC

(57) ABSTRACT

An original cover closer is described in which a compression coil spring can stably and surely work, an original cover can expeditiously and smoothly be operated, and the compression amount of the compression coil spring can be set and changed in an extremely easy manner. The cover closer comprises: a mounting member mounted to the main body of a copying machine; a supporting member pivotally attached to the mounting member and operable to support the original cover; a first slider and a second slider which are slidably installed in the supporting member; and a compression coil spring inserted between these sliders and operable to urge the original cover in the direction to open, wherein at least one of the sliders is formed integrally with a spring cover which covers the compression coil spring even when the original cover is opened.

1 Claim, 3 Drawing Sheets

OPENING/CLOSING DEVICE FOR DOCUMENT PRESSING DEVICE

TECHNICAL FIELD

The present invention relates to an original cover closer for use in a copying machine, a facsimile machine, a scanner or a multifunctional device thereof and the like.

BACKGROUND ART

A conventional type of this cover closer includes a mounting member which is mounted to the main body of a copying machine, a supporting member which is pivotally mounted on the mounting member and supporting an original cover, and a compression coil spring which is placed between the mounting member and the supporting member and urged in the direction to open the original cover (for example, refer to Japanese Patent Published Application No. 2006-010979).

However, in the above conventional original cover closer, the compression coil spring is exposed outside. Thereby, particularly when the cover closer is opened, there are problems in that an original document may touch the spring and be stained and tainted with oil, that some foreign object may be caught by the compression coil spring to cause damage and so forth.

In addition, in the above conventional original cover closer, there are problems in that it is not easy to adjust the compression amount of the compression coil spring and so forth.

It is an object of the present invention to provide an original cover closer in which a compression coil spring can stably and surely work, the original cover can expeditiously and smoothly be operated, and the compression amount of the compression coil spring can be set and changed in an extremely easy manner.

SUMMARY OF THE INVENTION

The original cover closer in accordance with the present invention comprises: a mounting member mounted to the main body of a copying machine; a supporting member pivotally mounted to the mounting member and operable to support the original cover; a first slider and a second slider which are slidably installed in the supporting member; and a compression coil spring inserted between these sliders and operable to urge the original cover in the direction to open, wherein at least one of the sliders is formed integrally with a spring cover which covers the compression coil spring even when the original cover is opened. Alternatively, the cover closer is characterized by a mounting member mounted to the main body of a copying machine; a supporting member pivotally attached to the mounting member and operable to support the original cover; a first slider and a second slider which are slidably installed in the supporting member; and a compression coil spring inserted between these sliders and operable to urge the original cover in the direction to open, wherein at least one of the sliders is assembled with a mechanism for adjusting the compression amount of the compression coil spring. Furthermore, the device is characterized in that the mechanism for adjusting the compression amount of the compression coil spring is installed between the compression coil spring and said at least one of the sliders and implemented with a spring regulation member which is threaded with this slider.

In accordance with the original cover closer of the present invention, there are advantages that the compression coil spring can stably and surely work, the original cover can expeditiously and smoothly be operated, and the compression amount of the compression coil spring can be set and changed in an extremely easy manner.

BEST MODE FOR CARRYING OUT THE INVENTION

Figure 1:
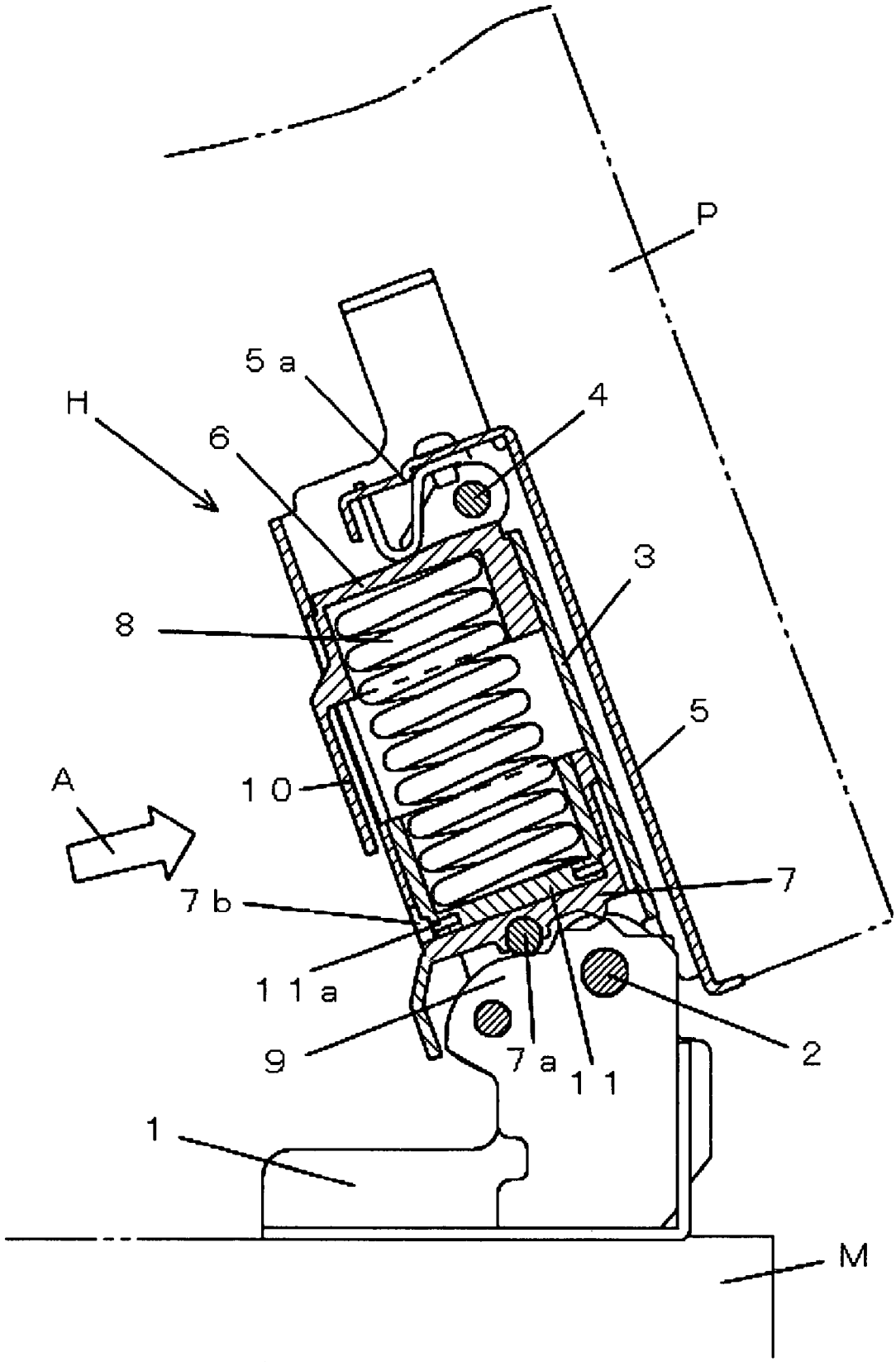
FIG. 1 is a cross sectional side view for showing an embodiment of the original cover closer in accordance with the present invention.
Figure 2:
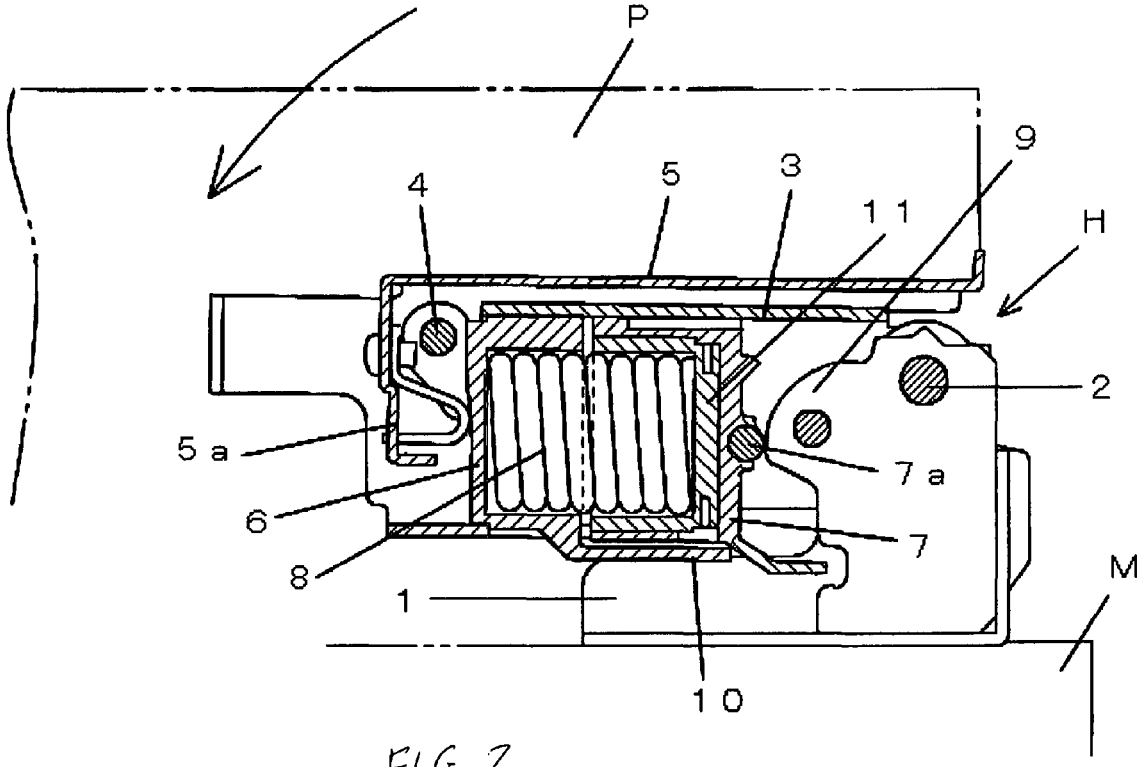
FIG. 2 is a view for explaining the main portion as seen from the direction of arrow A in FIG. 1.

In FIG. 1 and FIG. 2, an original cover P is mounted to the main body M of a copying machine or the like through a cover closer H such that it can be freely opened and closed. The above cover closer H is composed mainly of a mounting member 1 which is mounted to the main body M, a support arm 3 which is pivotally attached to the mounting member 1 through a hinge shaft 2, and a lift arm 5 which is pivotally attached to the end of the support arm 3 through a support shaft 4 and to which the original cover P is fixedly attached.

A first slider 6 and a second slider 7 are disposed in the support arm 3 such that they can slidably move in the longitudinal direction, and a compression coil spring 8 is inserted between the first and second sliders 6 and 7. The cam follower 6*a* of the first slider 6 abuts on an abutment portion 5*a* of the lift arm 5, and the cam follower 7*a* of the second slider 7 abuts on a cam portion 9 which is provided of the mounting member 1.

Incidentally, the cover closer H according to the present invention is not limited to the structure as described above, but can be any one of known structures, for example, a structure in which the support shaft 4 and the lift arm 5 are not used and the original cover P is fixedly attached to the support arm 3.

Figure 3:
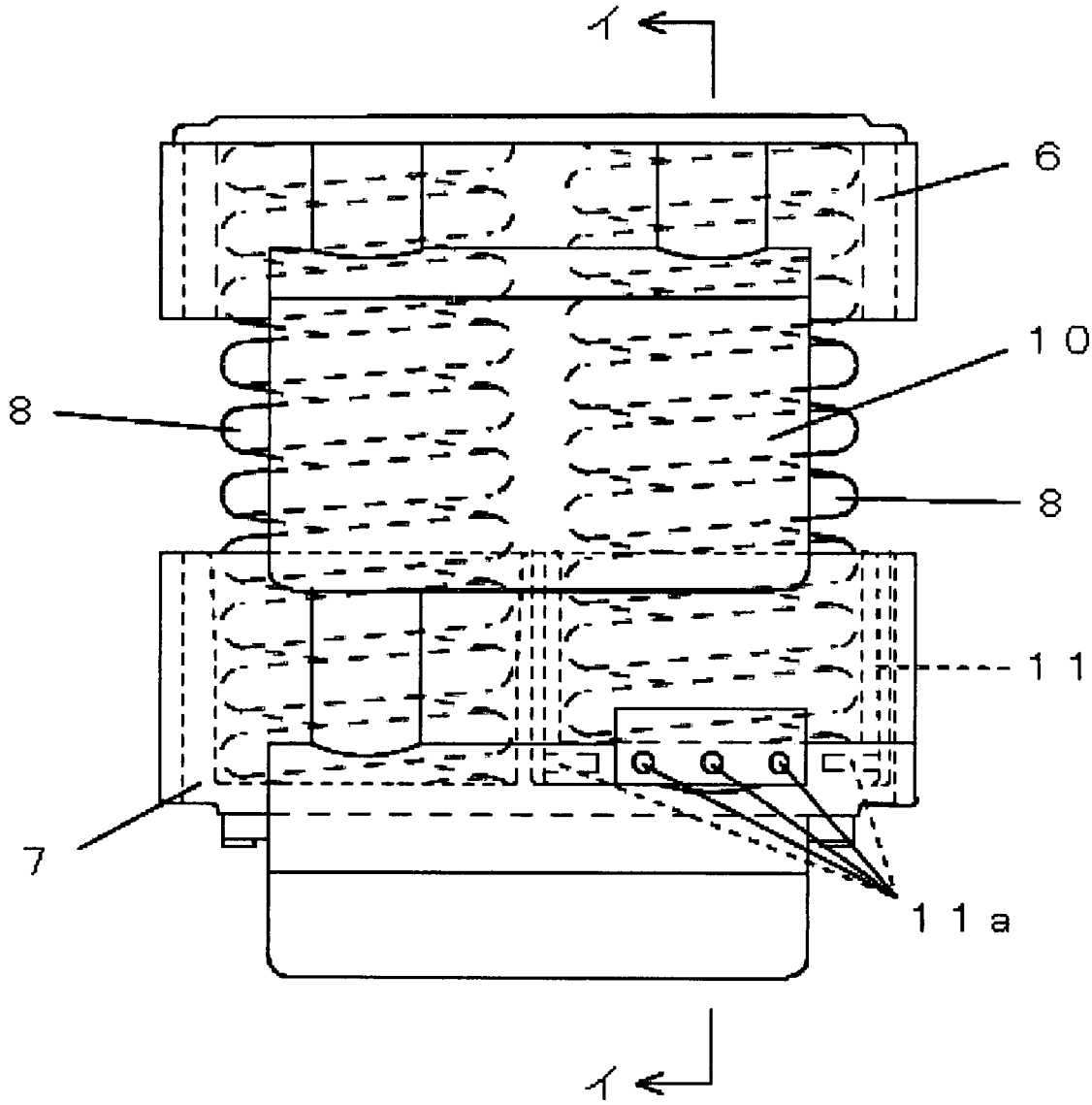
FIG. 3 is a cross sectional side view for showing the device of FIG. 1 which is closed.

The first slider 6 is integrally formed with a spring cover 10 which serves to protect the compression coil spring 8 by covering and hiding it. The spring cover 10 may be provided as a separate element from the first slider 6, and integrally attached and fixed to the first slider 6. As illustrated in FIG. 3, at least when the support arm 3 rotates in the closing direction so that the first slider 6 and the second slider 7 move toward each other (i.e., the compression coil spring 8 is compressed), the first slider 6 slides to overlap the second slider 7 at the spring cover 10 from the outside in order not to interfere with each other.

A spring regulation member 11 is installed between the compression coil spring 8 and the second slider 7. The cylindrical section of the spring regulation member 11 is externally threaded to screw with the thread externally formed around the cylindrical section of the second slider 7. Accordingly, the spring regulation member 11 moves toward or away from the second slider 7 by rotating it, and as a result the compression coil spring 8 is expanded or contracted to change the compression amount thereof, i.e., the repulsive force.

A plurality of holes 11*a* are formed all the way around the spring regulation member 11 at equal intervals as a means for rotating the spring regulation member 11, and an opening 7*b* is formed through the second slider 7 so that the holes 11*a* can be externally accessed. The opening 7*b* is sized in order that at least two of the holes 11*a* can be accessed, and hence the adjustment can be performed by inserting an appropriate pin (not shown in the figure) into the hole 11*a* and repeatedly rotating the spring regulation member 11 bit by bit.

While the present invention has been described in terms of embodiments, it is apparent to those skilled in the art that the invention is not limited to the embodiments described. The present invention can be practiced with modification and alteration within the spirit and scope of the appended claims. The description is thus to be regarded as illustrative instead of limiting in any way on the present invention.

The invention claimed is:

1. An original cover closer for a copying machine that includes an original cover and a main body, the cover closer comprising:

a mounting member fixed to the main body of the copying machine;

a supporting member pivotally attached to the mounting member and operable to support the original cover;

a first slider and a second slider which are slidably installed in the supporting member; and a compression coil spring inserted between these sliders and operable to urge the original cover in the direction to open, wherein at least one of the sliders is assembled with a mechanism for adjusting the compression amount of the compression coil spring, said mechanism comprising a spring regulation member installed between the compression coil spring and said at least one of the sliders, wherein said spring regulation member is threaded onto said at least one of the sliders to move towards or away therefrom when rotated and to adjust the compression amount of the compression coil spring.

* * * * *